US006239769B1

(12) United States Patent
Ericsson et al.

(10) Patent No.: US 6,239,769 B1
(45) Date of Patent: May 29, 2001

(54) ANTENNA CONNECTOR

(75) Inventors: Ina Ericsson; Aleksis Anterow, both of Åkersberga (SE)

(73) Assignee: Smarteq Wireless AB, Enebyherg (SE)

( * ) Notice: Subject to any disclaimer, the term of this patent is extended or adjusted under 35 U.S.C. 154(b) by 0 days.

(21) Appl. No.: 09/319,918

(22) PCT Filed: Dec. 17, 1997

(86) PCT No.: PCT/SE97/02141

§ 371 Date: Jul. 16, 1999

§ 102(e) Date: Jul. 16, 1999

(87) PCT Pub. No.: WO98/27610

PCT Pub. Date: Jun. 25, 1998

(30) Foreign Application Priority Data

Dec. 18, 1996 (SE) ..... 9604658
Feb. 28, 1997 (SE) ..... 9700729

(51) Int. Cl.[7] ..... H01Q 1/24
(52) U.S. Cl. ..... 343/906; 343/845
(58) Field of Search ..... 343/906, 905, 343/904, 702, 718, 845, 846, 848; 307/147; 379/457; 455/90

(56) References Cited

U.S. PATENT DOCUMENTS 4,220,955 9/1980 Frye ..... 343/703
5,057,847 * 10/1991 Vaisanen ..... 343/702
5,357,262 10/1994 Blaese ..... 343/906
5,577,269 * 11/1996 Ludewig ..... 455/90
5,659,889 * 8/1997 Cockson ..... 343/906
5,694,135 * 12/1997 Dikun et al. ..... 343/906
5,835,071 * 11/1998 Phelps ..... 343/906
5,914,693 * 6/1999 Takei et al. ..... 343/767

FOREIGN PATENT DOCUMENTS 2266997 11/1993 (GB) ..... H01Q/1/32
WO95/07556 3/1995 (WO) ..... H01Q/1/32
WO96/19845 6/1996 (WO) ..... H01Q/1/24

* cited by examiner

*Primary Examiner*—Don Wong
*Assistant Examiner*—Thuy Vinh Tran
(74) *Attorney, Agent, or Firm*—Jacobson, Price, Holman & Stern, PLLC

(57) ABSTRACT

The known antenna connectors for transmitting RF-signals from an outside antenna to a portable telephone includes a connecting cable (8), one end of which is connected to the outside antenna (11) and the second end which is connected with a circuit (4), which capacitively or inductively transmits the RF-signals from the outside antenna to a main antenna of the telephone. In order to improve the coupling performance said circuit consists of a meander formed loop (4) of conductive material, which loop (4) is arranged on a substrate (5) of non conducting material and in one end (6) is connected with the connecting cable (7). The cable has a screen (10) which is connected with a ground element (9), and couples with the ground plane of the telephone, whereat the meander formed loop is placed beside main antenna (11) when transmitting RF-signals.

20 Claims, 3 Drawing Sheets

ANTENNA CONNECTOR

BACKGROUND OF THE INVENTION

Field of the Invention

This invention refers to an antenna connector for coupling RF-signals from an outside antenna to a portable telephone, whereat the antenna connector includes a conductive cable in the form of a screened coaxial cable, one end of which is connected to the outside antenna and the second end of which is connected to a circuit, which transmits the RF-signals capacitively or inductively from the cable to a main antenna electrically coupled to the portable telephone.

Antenna connectors of the art are known from e.g. GB-A-2 266 997, U.S. Pat. Nos. 4,220,995 and 5,357,262.

GB-A-2 266 997 discloses an antenna connector, which can be applied to the outside of the housing of a portable telephone, the antenna of the portable telephone being encased in the housing. The circuit of the antenna connector, which transmits the signals to the telephone consists of a closed loop, so that an inductive coupling is established between the outside antenna and the antenna within the housing of the portable telephone.

U.S. Pat. No. 4,220,955 discloses an antenna connector device for a portable telephone, on the upper side of the housing of which a helix coil antenna is fastened. The antenna connector includes a sleeve which can be slided over the coil, the sleeve having a conduit which is wound along a screw line round the sleeve. An inductively acting transmission of signals is hereby established from the outside antenna to the antenna of the portable telephone.

U.S. Pat. No. 5,357,262 discloses an antenna connector which connects an outside antenna with an antenna of coaxial type attached to the top of the portable telephone. The antenna connector consists of several parts in order to establish a mechanical detachable connection between the antenna connector and the telephone and secondly to establish the signal connection. Such an antenna connector will be very expensive to produce because of the many co-operative parts, which demand accuracy when being produced. The antenna connector is further very sensitive to outside effects as humidity and the like, which can penetrate between the different parts.

SUMMARY OF THE INVENTION

The object of the invention is to improve the connecting properties between the outside antenna and the portable telephone.

A specific object of the invention is to make the antenna connector operable in at least one frequency band and not only for a specific frequency.

A further object of the invention is to provide a compact design of the antenna connector so that it operates like a so called coupled filter, a technique which is common within the microwave art, for instance in micro stripping, in order to establish a filter action. By placing the circuit of the antenna connector close to the main antenna of the portable telephone the electromagnetic field of the main antenna will couple to the connector and vice versa.

Further there is an object of the invention to provide a rough construction and a simple antenna connector, which is insensitive to exterior influence. The invention therefore has the characteristic features which are stated in the claims.

Two preferred embodiments of the invention will be described in the following with reference to the enclosed drawings.

DESCRIPTION OF THE INVENTION

Figure 1:
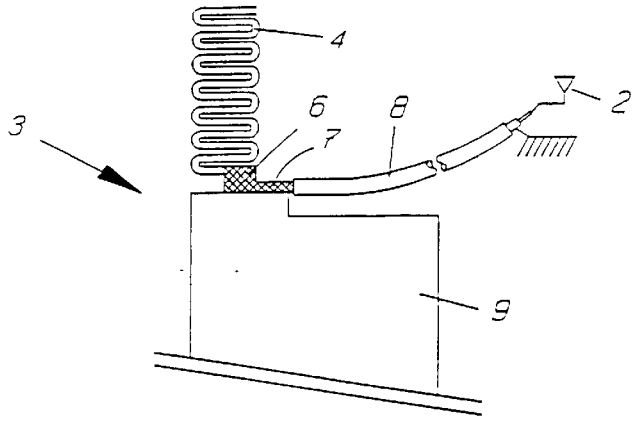
FIG. 1 is a schematic view of the first embodiment of the invention.

FIG. 1 shows schematically an antenna connector 3 according to the invention including a conductive cable 8 leading from an outside antenna 2. The other end of the conductive cable 8 is connected with a circuit 4. The main antenna 11 of the portable telephone is not shown in detail in FIG. 1 but can be a helical coil attached to the top end of the portable telephone. The main antenna 11 is used in the normal operation of the portable telephone. When the telephone is used on a screened place, e.g. inside an automobile the receiving conditions will be much improved by means of the outside antenna 2. The outside antenna 2 is therefore connected to the main antenna by means of the antenna connector 3. The antenna connector 3 transmits RF-signals to the main antenna of the portable telephone without being conductively connected with the main antenna.

The antenna connector 3 will now be described with reference to FIGS. 2 and 3. The antenna connector 3 comprises a meander formed circuit 4, which is applied on a substrate 5. The substrate 5 is of a non-conductive material. The meander formed circuit can be printed to the substrate in the form of an electric circuit or can be a conductor of electricity, which is attached to the substrate in meander form in a suitable way. Further, the meander formed circuit can be formed by painting conductive paint in meander form on the substrate. The size of the meander form can for instance be such that the width is 10 mm and that the height is 21 mm and that the conductor loop is 1 mm thick or wide. One end 6 of the conductor loop is conductively connected with the conductor 7 of the coaxial cable 8. The second end of the coaxial cable 8 is, as earlier mentioned, conductively connected with the outside antenna 2. The length of the meander formed circuit 4 is adapted to the wave length of the main antenna of the portable telephone in order to optimalize the coupling properties. Further, a matching circuitry must be conductively inserted between the meander formed circuit and the end of the coaxial cable in order to establish matching to the impedance of the coaxial cable. The matching unit can be in the form of descreet elements (not shown). The coaxial cable may be substituted by a double wire of known type.

The antenna connector further comprises a ground element 9. This element 9 is so placed in relation to the housing of the portable telephone that it couples effectively to the ground plane of the telephone (not shown) which is built in in the portable telephone. The ground element 9 is therefore preferably in the form of a plate, which is attached to the opposite side of the substrate 5 in relation to the side on which the meander formed circuit 4 is placed. As can be seen from FIG. 3 the substrate 5 and the ground element 9 are extended downwards under the bottom end of the meander formed circuit 4, which makes it possible to attach the antenna connector to the outside of the housing by the substrate. The ground element 9 is conductively connected with the screen 10 of the coaxial cable. It should be mentioned that it is not necessary that the ground element 9 is extended upwards behind the meander formed circuit but if so the coupling will be improved.

Alternatively the ground element 9 can be arranged on the same side of the substrate as the meander formed circuit but if so it must be placed under the circuit so that the ground element 9 can be situated alongside of the housing of the telephone.

Figure 2:
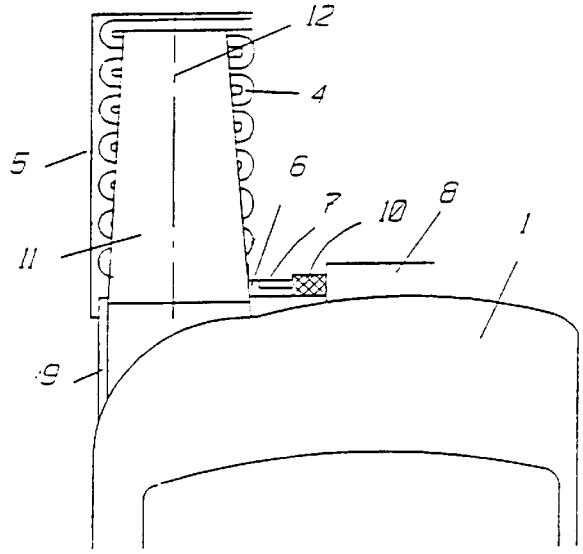
FIG. 2 is a schematic view which is enlarged in relation to FIG. 1 and shows the antenna connector and the upper part of the portable telephone.
Figure 3:
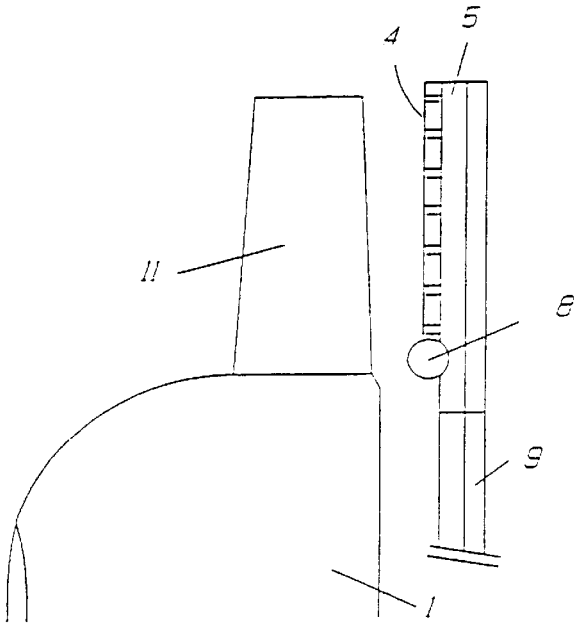
FIG. 3 is a similar figure to FIG. 2 but the portable telephone and the antenna connector are shown turned through an angle of 90° in relation to the position in FIG. 2.

The substrate 5 is thus attached to the outside of the housing of the portable telephone 1 so that the meander formed circuit 4 will be situated at the side of the helical antenna 11 as shown in FIGS. 2 and 3. For the best action the symmetry axis or the longitudinal axis of the helical coil antenna 11 and the longitudinal axis of the circuit should coincide with the line 12 in FIG. 2, when the meander form circuit and the helical antenna is viewed being placed behind each other. With other words, the symmetry axis of the meander formed circuit and the symmetry axis of the helical antenna shall both be in the plane, which is situated transversally to the plane of the meander formed circuit and passes through the longitudinal axis of the meander formed circuit. The invented idea is however not restricted to this exact position of the meander formed circuit in relation to the helical coil or other forms of the main antenna.

Figure 4:
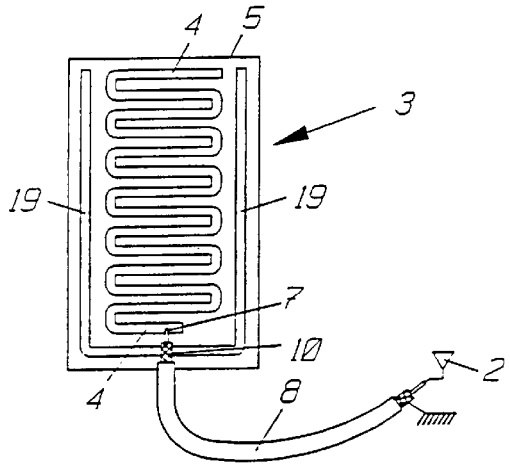
FIG. 4 is a schematic view of a second embodiment of the invention.
Figure 6:
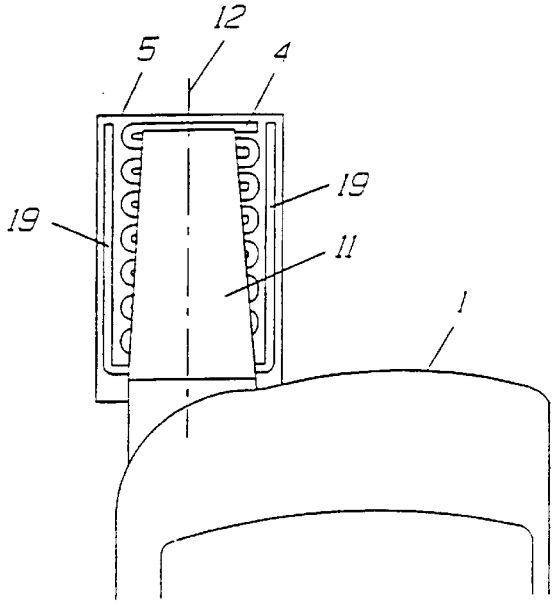
FIG. 6 is a view similar to FIG. 5 but the portable telephone and the antenna connector are turned through an angle of 90° in relation to the position in FIG. 4.
Figure 5:
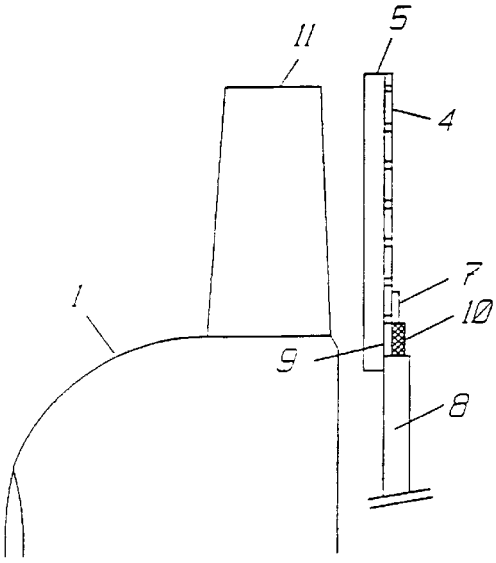
FIG. 5 is an enlarged view in relation to FIG. 4 showing the antenna connector and the upper part of the portable telephone.

A second embodiment of the invention is shown in FIGS. 4–6 in which especially the ground element is of a different form. The same reference figures as in FIGS. 1–3 are used for corresponding elements in FIGS. 4–6 and in the following description.

The antenna connector 3 comprises a meander formed circuit 4 as in the formed embodiment, with circuit is applied on the substrate 5. One end of the circuit 4 is conductively connected with the conductor 7 of the coaxial cable 8. The second end of the conductor 7 of the coaxial cable 8 is, as earlier described, conductively connected with the outside antenna 2.

In this embodiment the ground element is in the form of a U-formed side conductor 19, which is applied on the substrate and surrounds three sides of the meander formed circuit 4. The side conductor 19 is connected to the screen 10 of the coaxial cable. In the shown embodiment the side conductor 19 is symmetrical in relation to the circuit 4 but it can be asymmetrical in the meaning that it is one side conductor only on one side of the circuit 4. The side conductor 19 can alternatively be place on the opposite side of the substrate.

The substrate can be a plastic film or a tape sheet on which conductive material is applied in the form of the meander formed circuit 4 and the U-formed side conductor 19. A complete antenna connector 3 could also be produced as a printed circuit card, one-sided or twinsided.

The length of the loop forming the meander circuit could for instance be composed of units, each unit corresponding to a quarter wave length. It should however be observed that the antenna connector shall operate within a frequency band and not for only one single frequency. There is also a possibility to arrange the antenna connector in a sleeve which is slided over the helical antenna when in operation. Such a sleeve is formed from non-conducting material. It should once again be mentioned that the antenna connector can be used for other forms of main antennas than now described. It should also be mentioned that the circuit can have a modified meander form. The circuit thus can be in zigzag form, which outer shape is rectangular or triangular.

For proper operation of this embodiment the side conductor 19 must be placed beside the circuit. The side conductor 19 can be symmetrically arranged around the circuit or assymetrically on one and the same side of the circuit. The conductor can alternatively be applied on the other side of the substrate.

Figure 7:
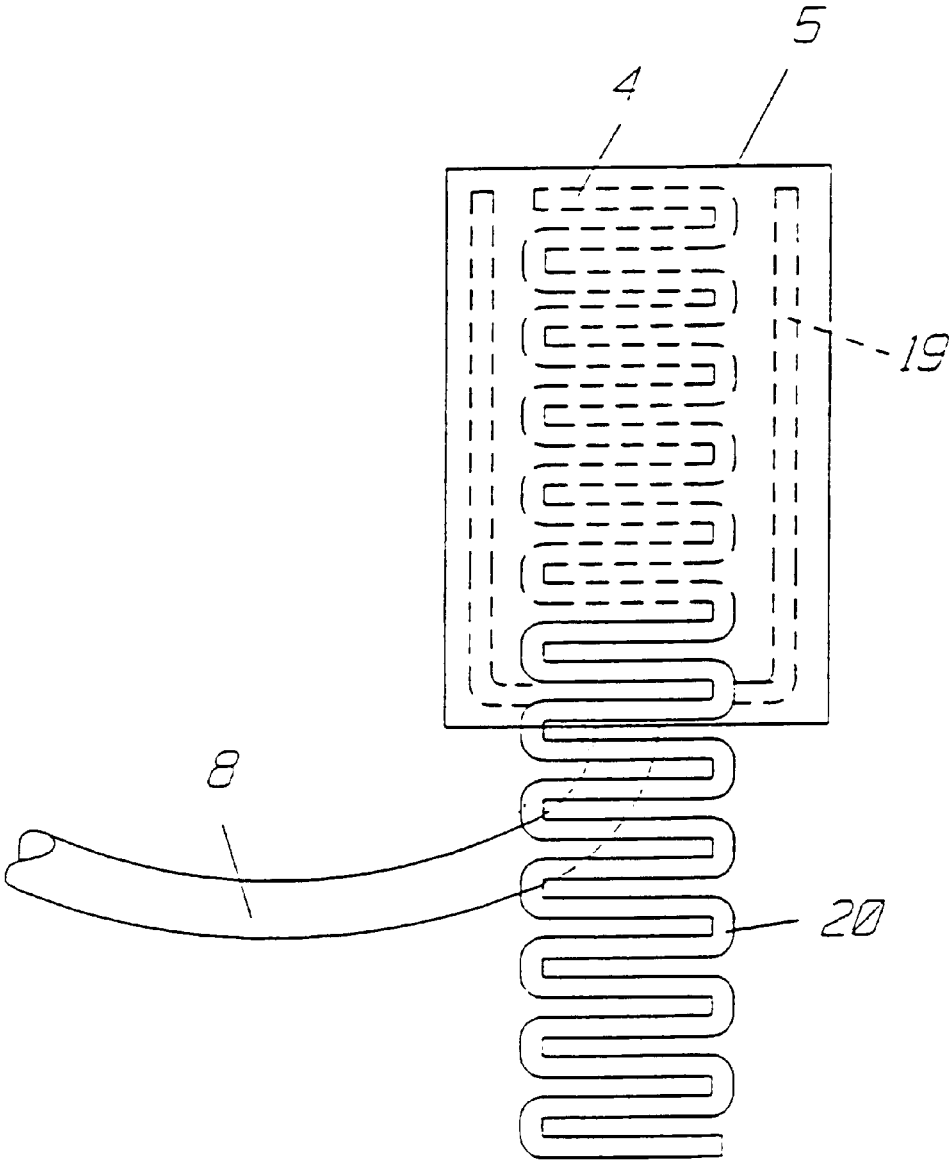
FIG. 7 is a view of a variation of the embodiment according to FIG. 4 viewed from the opposite side.

FIG. 7 shows a further embodiment of the invention and the antenna connector is shown from the opposite side to how it is shown in FIG. 4. By this embodiment the matching can be improved by that a foil of conductive material is applied on the opposite side of the substrate in relation to the meander formed circuit. This foil is also meander formed and is placed close to the area between the circuit and the side conductor. The position and the form can be adjusted in order to reach the wanted matching. In FIG. 7 this is shown by an additional conductor 20, which co-operates with the side conductor 19. The additional conductor 20 is conductively connected with the side conductor 19 or can be coupled capacitively to it. As can be seen from FIG. 7 the additional conductor 20 is in the form of a meander and it is extended under the side conductor 19 in order to coupled also with the ground plane of the telephone.

It should further be mentioned that the length of the side conductor 19 may be adjusted in order to improve the matching in the same way as the form of the circuit can be adapted in order to reach the best possible performance. The thickness of the substrate can be varied. Thus the antenna connector can consists of a one-sided substrate or a twin-sided. Moreover it is possible to use a tape as the substrate and the tape can then be attached directly to the housing of the telephone.

The size of the ground element 9 can be 60×40 mm. The length of the wire of the circuit can for instance correspond to units, which have a length of about a quarter wave length. It should however be observed that the antenna connector shall be able to work within a frequency band and not only for one single frequency. Further, the housing of the telephone can have a suitable attachment for the antenna connector. No attachment means is shown in the figure and is not described but it is possible to arrange a pocket or the like in which the lower part of the antenna connector is put into or the attachment means could be a Velcro tape or another detachable coupling means. As said above, the antenna connector alternatively can be arranged in a sleeve which is slided over the helical antenna. Such a sleeve shall be of a non-conducting material. Such a design will lead to that the meander formed circuit and the ground element has a curved configuration.

What is claimed is:

1. Antenna connector for transmission of RF-signals from an outside antenna to a wireless portable telephone, said antenna connector including a conductive cable having a first conductor and a second conductor, one end of said first conductor being connected with said outside antenna and the second end of said conductor being connected with a circuit, which transmits said RF-signals capacitively and/or inductively from said outside antenna to a main antenna of the portable telephone, said circuit comprises a meander formed loop of conductive material, said loop being arranged on a substrate of non-conducting material, and one end of said loop being connected with said first conductor of said connecting cable, said second conductor of said connecting cable being connected with a ground element, and the meander formed loop is placed beside said main antenna when transmitting RF-signals.

2. The antenna connector according to claim 1, wherein the meander formed loop is arranged so that the longitudinal axis of the main antenna and the longitudinal axis of said meander formed loop being in the plane, which is situated perpendicular to the plane of said meander formed loop.

3. The antenna connector according to claim 2, wherein the ground element is extended along the whole substrate.

4. The antenna connector according to claim 1, wherein the geometric extension of said ground element is in a plane, which is parallel to the plane of said meander formed loop.

5. The antenna connector according to claim 1, wherein the ground element is applied on the same side of the substrate as the meander formed loop and below it.

6. The antenna connector according to claim 1, wherein said ground element is designed as a plate, which is placed on the side of the substrate which is opposite to the side where said meander formed loop is arranged and that said ground element is extended under said meander formed loop.

7. The antenna connector according to claim 1, wherein the extension of the substrate is longer than the extension of said meander formed loop, so that the lower part of said substrate can be detachably applied to the outside of the housing of the telephone, and the meander formed loop will be situated beside said main antenna.

8. The antenna connector according to claim 1, wherein the ground element consists of at least one side conductor which is arranged beside and close to said meander formed loop.

9. The antenna connector according to claim 8, wherein said side conductor is in a plane, which is parallel with the plane of said meander formed loop.

10. The antenna connector according to claim 8, wherein said side conductor and said loop are in one and the same plane.

11. The antenna connector according to claim 8, wherein the side conductor and said loop are arranged on opposite sides of said substrate.

12. The antenna connector according to claim 8, wherein the side conductor is symmetrically formed in relation to said meander formed loop.

13. The antenna connector according to claim 8, wherein said side conductor is asymmetrically formed in relation to said meander formed loop.

14. The antenna connector according to claim 8, wherein said ground element consists of an additional conductor, which cooperates with said side conductor.

15. The antenna connector according to claim 14, wherein said additional conductor also forms a coupling means with the ground plane of the telephone.

16. The antenna connector according to claim 14, wherein said side conductor and said additional conductor are conductively separated and at least partly overlapping.

17. The antenna connector according to claim 14, wherein said additional conductor is in the form of a meander.

18. The antenna connector according to claim 1, wherein said substrate consists of a plastic film or a tape, said loop and said side connector consists of conductive material, which is applied to said plastic film or said tape.

19. The antenna connector according to claim 1, wherein said meander formed loop and said ground element have a curved form.

20. The antenna connector according to claim 1, wherein said main antenna is a helical coil.

* * * * *